United States Patent [19]

Babington

[11] Patent Number: 4,573,904

[45] Date of Patent: Mar. 4, 1986

[54] LIQUID DELIVERY APPARATUS AND METHOD FOR LIQUID FUEL BURNERS AND LIQUID ATOMIZERS

[75] Inventor: Robert S. Babington, 1113 Ingelside Ave., McLean, Va. 22101

[73] Assignee: Robert S. Babington, McLean, Va.

[21] Appl. No.: 476,453

[22] Filed: Mar. 17, 1983

[51] Int. Cl.[4] ..... F23D 5/12

[52] U.S. Cl. ..... 431/117; 431/118; 239/124; 239/433; 239/434

[58] Field of Search ..... 431/12, 117, 118, 175, 431/285, 89; 239/75, 433, 434, 427.3, 427.5, 124, 126, 103; 236/93 R; 60/743; 261/78 A

[56] References Cited

U.S. PATENT DOCUMENTS 3,425,058 1/1969 Babington ..... 431/117

4,155,700 5/1979 Babington ..... 431/117

*Primary Examiner*—Samuel Scott

*Assistant Examiner*—Noah Kamen

*Attorney, Agent, or Firm*—Pollock, Vande Sande & Priddy

[57] ABSTRACT

An improved apparatus and method for delivering liquid are disclosed for use in fuel burners or atomizers of the type which comprise a hollow atomizer bulb having a convex exterior surface which tapers toward a small aperture through which high pressure gas if forced to atomize liquid as it flows in a thin film over the bulb. To provide thinner films when lower atomization rates are desired and thicker films when higher atomization rates are desired, a feed tube is positioned above the atomizer bulb with its discharge opening oriented so that the vertical distance from its front edge to the surface of the bulb is from 1.5 to 2.0 times the vertical distance of its rear edge to the surface of the bulb. In another embodiment the discharge opening of the feed tube is elongated and has a major axis oriented transversely to the axis of the spray leaving the aperture.

19 Claims, 7 Drawing Figures

LIQUID DELIVERY APPARATUS AND METHOD FOR LIQUID FUEL BURNERS AND LIQUID ATOMIZERS

CROSS-REFERENCE TO RELATED APPLICATIONS

The present application is related to three other applications filed concurrently and entitled Flow Control Module and Method for Liquid Fuel Burners and Liquid Atomizers (two applications) Ser. No. 476,292 and Ser. No. 476,455 and Improved Atomization Apparatus and Method for Liquid Fuel Burners and Liquid Atomizers Ser. No. 476,454, now U.S. Pat. Nos. 4,507,074; 4,516,928; and 4,507,076 respectively.

TECHNICAL FIELD

The present invention concerns liquid fuel burners and liquid atomizers and methods of operating such burners and atomizers. The apparatus and method of the invention are particularly related to liquid feed systems for burners and atomizers of the type which incorporate an atomizer bulb having a smooth, convex exterior surface tapering toward an aperture. A flow of air or other gas is directed through the aperture to atomize fuel or other liquid as it flows in a thin film over the exterior surface of the atomizer bulb.

BACKGROUND ART

In January 1969, U.S. Pat. Nos. 3,421,692; 3,421,699 and 3,425,058 issued to Robert S. Babington, the present applicant, and his co-inventors. These patents disclose a type of liquid atomization apparatus which is particularly useful in liquid fuel burners. The principle involved in the apparatus, now frequently referred to as the "Babington principle," is that of preparing a liquid for atomization by causing it to spread out in a free-flowing thin film over the exterior surface of a plenum having an exterior wall which defines the atomizer bulb and contains at least one aperture. When gas is introduced into the plenum, it escapes through the aperture and thereby creates a very uniform spray of small liquid particles. By varying the number of apertures, the configuration of the apertures, the shape and spray characteristics of the surface, the velocity and amount of liquid supplied to the surface, and by controlling the gas pressure within the plenum, the quantity and quality of the resultant spray can be adjusted as desired to suit a particular burner application. Various arrangements of such atomization apparatus have been disclosed in other U.S. patents issued to the present applicant, namely U.S. Pat. Nos. 3,751,210; 3,864,326; 4,155,700; and 4,298,338. The disclosures of the patents mentioned in this paragraph are specifically incorporated by reference into this application.

So that liquid fuel burners and liquid atomizers constructed in accordance with the Babington principle will have the widest possible range of applications, it has been found desirable to provide the maximum possible variation in the volumetric flow rate of the atomized fuel or other liquid between the lowest and the highest flow rates required. For example, flow rates as low as 0.3785 liter (0.1 gallon) per hour may be required for some applications and as high as 3.785 liters (1.0 gallon) per hour may be required for others.

Once the particular geometry for a given atomization apparatus has been selected, however, changes in the flow rate of the atomized liquid must be made primarily by adjusting the flow rate of liquid onto the atomizer bulb. For the lowest flow rates desired, the liquid film thickness at the aperture preferably would be the thinnest achievable while still maintaining a continuous film over the exterior surface of the atomizer bulb. On the other hand, to provide higher flow rates of the atomized liquid, it is necessary to increase the thickness of the film at the aperture without increasing it so much that undesirably large liquid particles are formed. In the prior art apparatuses, a single liquid feed tube has been positioned above each atomizer bulb a distance of approximately 3.175 to 9.53 mm (0.125 to 0.375 inch) so that a variable flow rate of atomized liquid from about 0.757 to 2.27 liters (0.2 to 0.6 gallons) per hour has been achievable. Various applications have remained, however, in which flow rates above and below this range have been desired but have not been reliably achievable.

DISCLOSURE OF THE INVENTION

An object of the present invention is to provide an improved apparatus and method for delivering liquid fuel to an atomizer bulb which operates in accordance with the Babington principle so that both higher and lower flow rates can be achieved than have been found possible with prior art atomizer bulbs.

Another object of the invention is to provide such an apparatus and method in which the high intermediate and low flow rates produce essentially stable films at the aperture of the atomizer bulb.

A further object of the invention is to provide such an apparatus and method in which entrained gases or bubbles in the liquid are shed immediately from the feed tube delivering the liquid to the atomizer bulb and also from the surface of the atomizer bulb, to eliminate undesirable fluctuations in the liquid film flowing over the atomizers and, hence, fluctuations in the firing rate, which the presence of such bubbles would otherwise tend to cause.

Yet another object of the invention is to provide such an apparatus and method for feeding liquid fuel which can be used with atomizer bulbs made in accordance with the Babington principle but which have a variety of convex surfaces which taper toward the atomizing aperture.

These objects of the invention are given only by way of example; therefore, other desirable objectives and advantages inherently achieved by the disclosed apparatus may occur or become apparent to those skilled in the art. Nonetheless, the scope of the invention is to be limited only by the appended claims.

The apparatus and method according to the invention are particularly adapted for delivering liquid fuel or other liquid to an atomizing means of the type which includes a plenum having an exterior wall with a small aperture therethrough, the exterior surface of this wall being smooth and convex and tapering toward the aperture. A feed tube is provided through which liquid is to be flowed over the exterior surface and across the aperture, the tube having a downwardly directed, essentially straight portion with a center line. The straight portion terminates above the plenum with a discharge opening which is positioned with its front edge closer to the aperture than its rear edge and with the extended center line of the tube reaching a convex portion of the exterior surface of the plenum.

In one embodiment, the vertical distance from the front edge of the discharge opening to the convex portion preferably is about 1.5 to 2.0 times the vertical distance from the rear edge to the exterior surface. As a result of this configuration, when liquid flows through the feed tube at flow rates sufficient just to cover the exterior surface of the plenum with a thin film suitable for low atomization rates, a bulbous-shaped stream is established between the discharge opening and the surface of the atomizer bulb. The bulbous-shaped stream preferentially directs itself more away from the aperture than would a stream flowing parallel to the discharge leg of the feed tube. On the other hand, when liquid flows through the tube at relatively high flow rates sufficient to smoothly cover the exterior surface of the plenum with a thicker film suitable for higher atomization rates, the stream between the discharge opening and exterior surface preferentially directs itself toward the aperture. At liquid flow rates in between these minimum and maximum conditions, the path of liquid leaving the feed tube is parallel to the axis of the discharge leg of the feed tube, as one might expect. Thus, a thinner film is formed over the aperture at lower flow rates through the feed tube due to the bulbous effect and a thicker film is formed over the aperture at higher flow rates through the feed tube because of a forward deflection of the liquid, so that respectively lower and higher flow rates of atomized liquid can be achieved.

In this embodiment of the invention, the plane of the discharge opening of the feed tube is horizontal; however, it is also within the scope of the invention to position the rear edge of the discharge opening below the front edge. In such a case, the vertical distance from the front edge of the tube preferably is at least equal to the inside diameter of the feed tube. In order to ensure smooth flow from the discharge opening of the feed tube, its downwardly directed, essentially straight portion preferably has length about 10 to 15 times the inside diameter of the tube.

In another, preferred embodiment of the invention, the discharge end of the otherwise cylindrical feed tube is flattened into a somewhat "duckbill" configuration having a flow area shaped as an elongated oval with major and minor axes. The plane of this oval discharge opening preferably is essentially parallel to a plane tangent to the upper surface of the atomizer bulb with the major axis of the oval discharge opening preferably essentially perpendicular to the spray axis of the atomizer bulb. In this preferred embodiment, the stable minimum film thickness at the aperture is less than can be reliably achieved with the previously described embodiment, for the same minimum flow rate through the feed tube. Also, a greater, stable maximum film thickness can be achieved at the aperture with a smaller maximum flow rate through the feed tube, than can be reliably achieved with the previously described embodiment. In the latter case, less fuel must be recirculated at the maximum atomization rate, so that reduced pump capacity is needed. In addition, the reduced liquid flow over the atomizer bulb provides better film stability and causes the drain-off liquid stream to be more or less laminar,.thereby facilitating its removal and return to the sump. This preferred embodiment is also very effective in shedding bubbles that might otherwise hang up in the space between the atomizer bulb and the discharge end of the feed tube.

In the preferred embodiment, the sensitivity of the film thickness at the aperture of the atomizer bulb to changes in the flow rate in the feed tube decreases dramatically as the major axis of the oval discharge opening is rotated from a position perpendicular to the spray axis to a position parallel to the spray axis. In the latter, limiting case, the film thickness at the orifice remains essentially stable regardless of changes in the flow rate in the feed tube. However, when the major axis of the oval discharge opening is parallel to the spray axis, the feed system continues to resist formation of bubbles between the feed tube and the atomizer bulb.

BEST MODE FOR CARRYING OUT THE INVENTION

Figure 1:
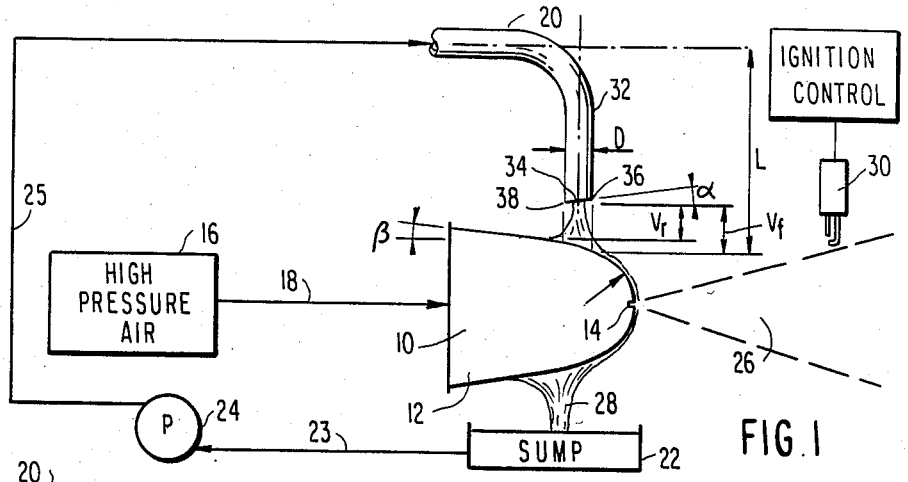
FIG. 1 shows a fragmentary elevation view of an atomizer bulb which operates in accordance with the Babington principle, a feed tube for liquid fuel positioned above the atomizer bulb in accordance with one embodiment of the present invention and the associated air and fuel sources and ignition device necessary to comprise a complete fuel burner.

The following is a detailed description of several embodiments of the present invention, reference being made to the drawing in which like reference numerals identify like elements of structure in each of the several Figures.

FIG. 1 shows a system for atomizing liquid fuel or other liquid, which operates in accordance with the Babington principle. An atomizer bulb 10 comprises an enveloping, convex exterior wall 12 which defines an internal plenum (not illustrated) and includes a frontal aperture 14, typically a narrow horizontal slit passing completely through the exterior wall. A source 16 of high pressure air or other gas is connected to the plenum defined by exterior wall 12 by means of a conduit 18 so that in operation a flow of air is caused to pass through aperture 14. Positioned above atomizer bulb 10 is a liquid feed tube 20 which preferably has a circular cross-section but may also have other cross-sections without departing from the scope of the present invention. Liquid drawn from a sump 22 through a conduit 23 by a pump 24 is caused to flow through a further conduit 25 into feed tube 20 from which it flows over atomizer bulb 10 and forms a film of liquid which completely covers the surface of bulb 10. As air flows through aperture 14, the film of liquid continuously forming at the aperture is continuously broken into tiny droplets of liquid which move away in the form of a fine, conical spray 26 of atomized liquid. Liquid not atomized to form spray 26 flows from the lower side of bulb 10 as a stream 28 which is directed back to sump 22, as illustrated. To complete the schematic illustration of a fuel burner, FIG. 1 also shows an igniter 30 which extends to spray 26 at a downstream location in order to ignite the fuel in the manner described more completely in the previously-mentioned patents.

In prior art liquid fuel burners and liquid atomizers which operate in accordance with the Babington principle, the firing rate of the burner, or the atomizing rate, is varied by changing the volumetric flow rate of liquid in spray 26. In a typical prior art application, a flow of approximately 7.6 to 45.4 liters (2 to 12 gallons) per hour through feed tube 20 results in a spray flow rate or firing rate of approximately 0.76 to 2.27 liters (0.2 to 0.6 gallons) per hour. The change in flow rate through feed tube 20 causes a corresponding change in the thickness of the film reaching aperture 14 so that a change in firing or atomizing rate is achieved.

Figure 2:
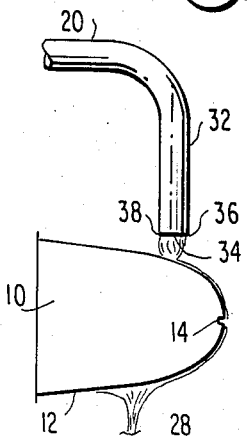
FIG. 2 shows a fragmentary elevation view of a liquid fuel atomizer according to one embodiment of the present invention and particularly illustrates the direction of flow of fuel away from the atomizing aperture at low fuel flow rates.
Figure 3:
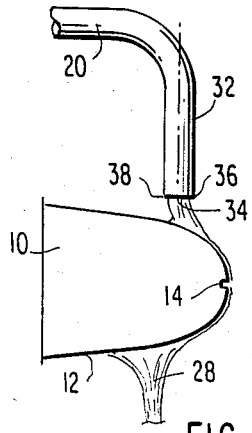
FIG. 3 shows a fragmentary elevation view of a liquid fuel atomizer according to one embodiment of the present invention and particularly illustrates the flow of the fuel toward the atomizing aperture at high fuel flow rates.

In accordance with the embodiment of the present invention shown in FIGS. 1 to 3, the position of feed tube 20 is selected so that at the lower flow rates through feed tube 20, the stream of liquid leaving the feed tube is preferentially directed away from aperture 14 so that a thinner film is produced at aperture 14 than has heretofore been achievable. Conversely, at the higher flow rates through feed tube 20, the stream of liquid leaving the feed tube is preferentially directed toward aperture 14 so that a thicker film is achieved.

As shown in FIG. 1, feed tube 20 has an essentially straight portion 32 which extends downwardly toward atomizer bulb 10 and includes a centerline, as illustrated. The length L of portion 32 preferably is ten to fifteen times the internal diameter D of feed tube 20 that any irregularities in flow through the feed tube 20 will have dissipated, for the most part, by the time the liquid issues from discharge opening 34. In accordance with this embodiment of the invention, the front edge 36 of discharge opening 34 is positioned further away from the surface of bulb 10 than is the rear edge 38 of discharge opening 34; and the center line of portion 32 is positioned so that it passes through a convex area of exterior wall 12 as illustrated. Wall 12 preferably has an exterior surface which is smooth, convex and tapered toward aperture 14. As used in this application, "convex" means that geometric normals will diverge when constructed at neighboring points on the "convex" portion of bulb 10. Thus, at the tip of atomizer bulb 10, the exterior wall 12 may be spherical having a radius R, ellipsoidal, hyperbolic, parabolic, and so forth. The portion of bulb 10 to the rear of the center line of feed tube 20 may be a right circular cylinder, a frustrum of a cone whose sides diverge at an angle $\beta$ or the other half of a sphere, ellipsoid, paraboloid or the like.

In accordance with the invention, the vertical distance $V_f$ from front edge 36 to exterior wall 12 and the vertical distance $V_r$ from rear edge 34 to the surface of wall 12 are chosen so that $V_f$ is approximately 1.5 to 2.0 times larger than $V_r$. In this embodiment, front and rear edges 36 and 38 are in a common horizontal plane; however, it is also within the scope of the invention to position point 38 below point 36, or vice versa, as indicated by angle $\alpha$ in FIG. 1. Whether $\alpha$ is positive (i.e., edge 38 below edge 36) or negative as would be the case if edge 36 was below edge 38, depends upon the flow rate through tube 32, and the amount and size of air or gas bubbles contained in the liquid stream. If the burner is to be operated at generally lower firing rates a positive $\alpha$ is preferred, whereas at higher firing rates a negative $\alpha$ is preferred. In general it is easier to shed large air bubbles when $\alpha$ is positive, but the corresponding film is not as stable at high flow rates. Because of these tradeoffs, and the desirability of a burner to handle a variety of fuels over a wide firing rate range, an $\alpha$ of 0° is often selected as a happy medium and for ease of manufacturing.

When feed tube 20 is configured and positioned in the manner just described, the flow of liquid through discharge opening 34 displays unexpected and important characteristics. FIG. 2 illustrates the position assumed by the stream of liquid leaving discharge opening 34 when the flow through feed tube 20 is at the lowest possible flow which still achieves a complete film on the exterior surface of bulb 10. As shown in FIG. 2, the stream takes on a rearwardly directed bulbous shape which preferentially directs fuel away from aperture 14 because the bulbous stream touches the atomizing surface closer to edge 38 than to edge 36. This occurs because the axis of leg 32 intersects the convex surface of atomizer bulb 10. As a result, the film of liquid fuel formed at aperture 14 is quite thin and the firing or atomizing rate is proportionately smaller. As the flow of liquid through feed tube 20 is increased, the stream leaving discharge opening 34 gradually assumes a more vertical position as illustrated in FIG. 1 and the amount of liquid leaving in spray 26 increases accordingly. Finally, as illustrated in FIG. 3, when the flow through feed tube 20 is increased to the maximum consistent with maintaining a smooth film of liquid on the exterior surface of bulb 10, the stream of liquid leaving discharge aperture 14 preferentially shifts itself toward the front of atomizer bulb 10. This causes a relatively thicker film to form at aperture 14 which results in a correspondingly higher flow of liquid in spray 26.

The following dimensions represent some typical values for a liquid fuel atomizer, according to the embodiment of FIGS. 1 to 3, which will produce a variable atomization rate from about 1.1 to about 3 liters (0.29 to about 0.79 gallons) per hour based on fuel feed rates of about 7.5 to 45 liters (1.98 to 11.89 gallons) per hour through feed tube 20. A typical atomizer bulb 10 has an essentially spherical convex portion having an outside diameter of about 10.2 to 1.5 mm (0.4 to 0.6 inches) The cross-sectional area of discharge aperture 14 typically is about $10.97\times10^{-4}$ to $12.26\times10^{-4}$ cm$^2$ ($1.7\times10^{-4}$ to $1.9\times10^{-4}$ square inches) and the pressure applied to the interior of atomizer bulb 10 typically is in the range of 1.02 to 1.6 bar (15 to 23.5 psi). The spacing between the lower end of feed tube 20 at rear edge 38 and the surface of atomizer bulb 10 preferably is from about 1.78 to 2.54 mm (0.070 to 0.100 inch). The spacing between the forward edge 36 of the feed tube and a vertical line through aperture 14 is normally between 1.02 to 1.65 mm (0.040 to 0.065 inch) while the internal diameter of tube 32 is between about 2.16 to 2.54 mm (0.085 to 0.100 inch). Liquid fuel atomizers thus configured and operated have been found to exhibit the desired flow switching characteristics when operated with liquid fuels having a viscosity range of 2.0 to 10.0 centistokes.

FIGS. 4 to 7 show the preferred embodiment of a liquid fuel delivery apparatus according to the invention. Here, feed tube 20 is formed from a blank 20', shown in FIG. 4, for example made from about 3.18 mm (0.125 inch) outside diameter, about 2.36 mm (0.093 inch) inside diameter stainless steel tubing. Blank 20' has a horizontal upper portion 40 and a downwardly extending, forwardly angled portion 42. The angle $\gamma$ between portions 40 and 42 preferably is about 100°, but may be in the range of 90° to 110° without departing from the scope of the invention. So that the plane of the discharge opening of the feed tube ultimately will be essentially parallel to a plane tangent to the upper surface of an atomizer bulb of the type previously described, the discharge end 44 of blank 20' preferably slopes upwardly and rearwardly at an angle $\delta$ of about 20°, but may slope at an angle in the range 10° to 30° without departing from the scope of the invention.

Figure 5:
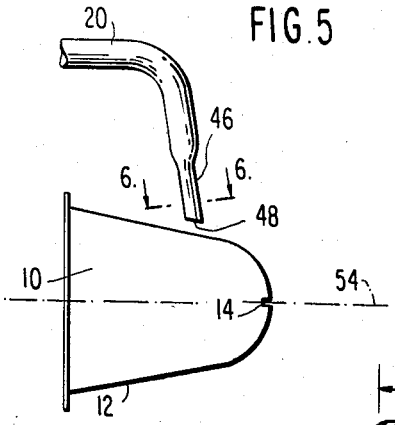
FIG. 5 shows an elevation view of a feed tube according to the preferred embodiment of the invention, in the preferred position above the automizer bulb.
Figure 6:
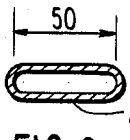
FIG. 6 shows a section view taken on line 6—6 of FIG. 5.

In the preferred embodiment of the invention, discharge end 44 of blank 20' is flattened transversely to the plane of the center lines of portions 40 and 42, as shown in FIGS. 5 and 6, to provide a short flow passage 46 and discharge opening 48 having a flow area shaped as an elongated oval with a major axis 50 and a minor axis 52. For a blank 20' of the size and material previously described, the tube is squeezed until the minor axis 52 is approximately 1.4 mm (0.055 inch) and the major axis is 3.30 mm (0.130 inch). The axial length of flow passage 46, the "duckbill" portion of the feed tube, preferably is in the range of 6 to 9 mm (0.250 to 0.350 inch) to ensure that any flow irregularities induced by the change in cross-section will be adequately damped by the time the fuel discharges from opening 48.

Figure 4:
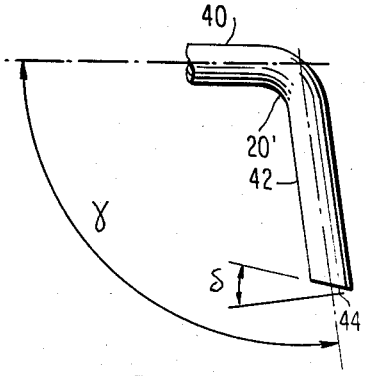
FIG. 4 shows an elevation view of a tubular blank used to make a feed tube for use in the preferred embodiment of the invention.

A feed tube configured as shown in FIGS. 4–6 preferably is positioned directly above atomizer bulb 10 so that the plane of the discharge opening 48 is 0.51 to 0.76 mm (0.020 to 0.030 inch) above the surface of the atomizer bulb; the leading edge of opening 48 is 5.1 to 6.4 mm (0.200 to 0.250 inch) behind aperture 14; and major axis 50 is essentially perpendicular to the spray axis 54 of the atomizer bulb. In this configuration, the thickness of the film at aperture 14 varies smoothly from a minimum at a flow rate through feed tube 20 of about 7.6 liters (2.0 gallons) per hour corresponding to an automization rate of about 0.56 liters (0.15 gallons) per hour, to a maximum at a flow rate through feed tube 20 of about 30 liters (8.0 gallons) per hour corresponding to an atomization rate of about 3.8 liters (1.0 gallons) per hour. Bubbles in the fuel do not tend to adhere between discharge opening 48 and the upper surface of atomizer bulb 10, primarily because of the close spacing between end 48 and the surface of atomizer 10.

Figure 7:
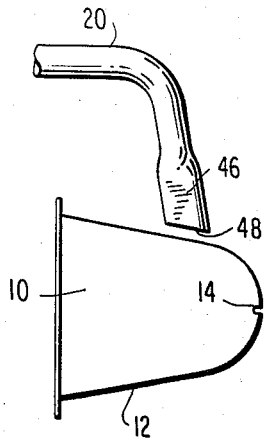
FIG. 7 shows an elevation view of an alternative configuration of a feed tube according to the preferred embodiment of the invention, as positioned above the atomizer bulb.

As major axis 50 is rotated relative to spray axis 54, while maintaining essential parallelism between the plane of discharge opening 48 and a plane tangent to the upper surface of the atomizer bulb, the thickness of the film at aperture 14 and the corresponding atomization rate vary less and less with changes in the flow rate through feed tube 20. When duckbill portion 46 is positioned so that major axis 50 is essentially parallel to spray axis 54 as shown in FIG. 7, virtually no change in atomization rate is experienced due to changes in the flow rate through feed tube 20. Thus, the configuration of FIG. 7 may be preferable where substantial fluctuations in flow are anticipated in conduit 25 and where the burner is to be operated at an essentially constant fuel rate. However, the atomization rate remains essentially stable in this limiting case and bubbles in the fuel do not tend to adhere between discharge opening 48 and the upper surface of atomizer bulb 10, for the same reasons as previously mentioned.

Industrial Applicability

While the present invention has been disclosed as particularly suited for use in liquid fuel burners, those skilled in the art will recognize that its teachings also may be followed for other applications of the Babington principle where it is desired to obtain a maximum variation in the flow rate of the vaporized liquid.

Having described my invention in sufficient detail to enable those skilled in the art to make and use it, I claim:

1. In an atomizing means of the type including a plenum having an exterior wall with a small aperture therethrough through which pressurized air delivered from pressurized source means is caused to issue, the exterior surface of said wall being smooth and convex, the improvement comprising:

a tube through which liquid fuel from a fuel supply means is to be flowed over said exterior surface and across said aperture, said tube having a downwardly directed, substantially straight portion at its exit end with a center line, said straight portion terminating above said plenum with a discharge opening having its front edge closer to said aperture than its rear edge, the distance from said front edge to said convex portion being from 1.5 to 2.0 times the distance from said rear edge to said convex portion both distances being measured parallel to said centerline, whereby when fuel flows through said tube at low flow rates suitable for low atomization rates, said tube causes the fuel stream between said discharge opening and said exterior surface to take on a bulbous shape which minimizes the film thickness at said aperture; and when fuel flows through said tube at higher flow rates suitable for high atomization rates, said tube causes the fuel stream between said discharge opening and said exterior surface to direct itself toward said aperture to thereby increase the film thickness at said aperture and means for igniting said atomized liquid fuel.

2. Apparatus according to claim 1, wherein said rear edge of said discharge opening is positioned below said front edge.

3. Apparatus according to claim 1, wherein said rear edge of said discharge opening is positioned above said front edge.

4. Apparatus according to claim 1, wherein said vertical distance from said front edge is at least equal to the inside diameter of said tube.

5. Apparatus according to claim 1, wherein said downwardly directed, essentially straight portion of said tube has a length in the range of ten to fifteen times the inside diameter of said tube.

6. Apparatus according to claim 1, wherein said center line is at an angle of 0° to 10° from the vertical toward said aperture.

7. An improved apparatus for atomizing liquids, comprising:

a plenum having an exterior wall with a small aperture therethrough, the exterior surface of said wall being smooth and convex and tapering toward said aperture;

first means for providing a variable flow of liquid to be atomized;

second, feed tube means for receiving said flow from said first means and directing said flow onto said exterior surface, said feed tube means having an axis and a downwardly facing discharge opening which is elongated transversely to said axis, said elongated discharge opening having a major axis and being positioned above said exterior surface at a location spaced from said aperture; and third means for directing a flow of gas through said plenum to atomize liquid flowing over said aperture and produce a spray of liquid, said spray having an axis.

8. Apparatus according to claim 7, wherein said major axis of said elongated discharge opening is transverse to said spray axis.

9. Apparatus according to claim 7, wherein said feed tube means is flattened to provide said discharge opening elongated transverse to said axis of said feed tube means.

10. Apparatus according to claim 7, wherein said discharge opening is located in a plane essentially parallel to said exterior surface.

11. Apparatus according to claim 7, wherein said liquid is a fuel, further comprising means for igniting said spray.

12. Apparatus according to claim 7, wherein said feed tube means has the additional function of preventing bubbles in said liquid from adhering between said discharge opening and said exterior surface.

13. An improved method for atomizing liquids, comprising the steps of:

providing a plenum having an exterior wall with a small aperture therethrough, the exterior surface of said wall being smooth and tapering toward said aperture;

providing a variable flow of liquid to be atomized;

feeding said flow downwardly onto said exterior surface through a feed conduit having a downwardly facing discharge opening which is elongated transversely to the direction of flow of said liquid, said discharge opening having a major axis; and directing a flow of gas through said plenum to atomize liquid flowing over said aperture and produce a spray of said liquid, said spray having an axis.

14. A method according to claim 13, further comprising the step of orienting said major axis transverse to said spray axis.

15. A method according to claim 14, further comprising the step of positioning said discharge opening in a plane essentially parallel to said exterior surface.

16. A method according to claim 15, wherein said liquid is a fuel, further comprising the step of igniting said spray.

17. An improved liquid fuel burner, comprising:

a plenum having an exterior wall with a small aperture therethrough, the exterior surface of said wall being smooth and convex;

means for directing a flow of pressurized air into said plenum and through said aperture;

means comprising a tube having a front edge closer to said aperture than its rear edge for flowing a stream of liquid fuel downward onto said exterior surface to produce a film of liquid at said aperture, the film being ruptured continuously by said flow of air to atomize said liquid fuel, said rear edge of said discharge opening of said tube being positioned below its said front edge;

whereby said tube means and plenum causes said stream of liquid fuel (a) to preferentially direct itself away from said aperture when said fuel flows at low flow rates sufficient to cover said exterior surface with a film of liquid fuel and to cover at least that portion of said exterior surface which is adjacent said aperture with a thin film suitable for low atomization rates and (b) to preferentially direct itself toward said aperture when said fuel flows at high flow rates sufficient to smoothly cover said exterior surface with a thicker film adjacent said aperture suitable for high atomization rates; and means for igniting said atomized liquid fuel.

18. An improved liquid fuel burner, comprising:

a plenum having an exterior wall with a small aperture therethrough, the exterior surface of said wall being smooth and convex;

means for directing a flow of pressurized air into said plenum and through said aperture;

means comprising a tube having a front edge closer to said aperture than its rear edge for flowing a stream of liquid fuel downward onto said exterior surface to produce a film of liquid at said aperture, the film being ruptured continuously by said flow of air to atomize said liquid fuel, said rear edge of said discharge opening of said tube being positioned above its said front edge;

whereby said tube means and plenum causes said stream of liquid fuel (a) to preferentially direct itself away from said aperture when said fuel flows at low flow rates sufficient to cover said exterior surface with a film of liquid fuel and to cover at least that portion of said exterior surface which is adjacent said aperture with a thin film suitable for low atomization rates and (b) to preferentially direct itself toward said aperture when said fuel flows at high flow rates sufficient to smoothly cover said exterior surface with a thicker film adjacent said aperture suitable for high atomization rates; and means for igniting said atomized liquid fuel.

19. An improved liquid fuel burner, comprising:

a plenum having an exterior wall with a small aperture therethrough, the exterior surface of said wall being smooth and convex;

means for directing a flow of pressurized air into said plenum and through said aperture;

means comprising a tube having a front edge closer to said aperture than its rear edge for flowing a stream of liquid fuel downward onto said exterior surface to produce a film of liquid at said aperture, the film being ruptured continuously by said flow of air to atomize said liquid fuel, the vertical distance from said front edge of said tube from said exterior surface of said plenum being at least equal to the inside diameter of said tube;

whereby said tube means and plenum causes said stream of liquid fuel (a) to preferentially direct itself away from said aperture when said fuel flows at low flow rates sufficient to cover said exterior surface with a film of liquid fuel and to cover at least that portion of said exterior surface which is adjacent said aperture with a thin film suitable for low atomization rates and (b) to preferentially direct itself toward said aperture when said fuel flows at high flow rates sufficient to smoothly cover said exterior surface with a thicker film adjacent said aperture suitable for high atomization rates; and means for igniting said atomized liquid fuel.

* * * * *